US009127530B2

(12) United States Patent
Lowdon et al.

(10) Patent No.: US 9,127,530 B2
(45) Date of Patent: Sep. 8, 2015

(54) COLLISION AVOIDANCE SYSTEM WITH OFFSET WELLBORE VIBRATION ANALYSIS

(75) Inventors: Ross Lowdon, Aberdeen (GB); Ian Farmer, Copenhagen (DK)

(73) Assignee: Schlumberger Technology Corporation, Sugar Land, TX (US)

( * ) Notice: Subject to any disclaimer, the term of this patent is extended or adjusted under 35 U.S.C. 154(b) by 1059 days.

(21) Appl. No.: 12/570,030

(22) Filed: Sep. 30, 2009

(65) Prior Publication Data

US 2011/0031016 A1 Feb. 10, 2011

Related U.S. Application Data

(60) Provisional application No. 61/232,105, filed on Aug. 7, 2009.

(51) Int. Cl.
*E21B 47/022* (2012.01)

(52) U.S. Cl.
CPC ..... *E21B 47/02208* (2013.01)

(58) Field of Classification Search
CPC ..... E21B 44/005; E21B 47/02208
USPC ..... 175/40, 45, 61; 181/104; 166/250.01, 166/253.01, 250.14; 33/304, 313; 702/9; 367/35
See application file for complete search history.

(56) References Cited

U.S. PATENT DOCUMENTS 4,003,017 A * 1/1977 Bailey ..... 367/81
4,582,147 A * 4/1986 Dardick ..... 175/1
5,131,477 A * 7/1992 Stagg et al. ..... 175/40
5,419,405 A * 5/1995 Patton ..... 175/27
6,073,079 A * 6/2000 Thomas ..... 702/9
6,088,294 A * 7/2000 Leggett et al. ..... 367/25
6,192,983 B1 * 2/2001 Neuroth et al. ..... 166/250.15
6,315,062 B1 * 11/2001 Alft et al. ..... 175/45

(Continued)

FOREIGN PATENT DOCUMENTS

WO 81/01168 4/1981
WO 92/13167 8/1992
WO 2009/073008 6/2009

OTHER PUBLICATIONS

Thorogood, J.L., Sawaryn, S.J., BP Exploration Co. Ltd; Abstract, "The Traveling-Cylinder Diagram: a Practical Tool for Collision Avoidance"; Mar. 1991, SPE Drilling Engineering; vol. 6, No. 1, pp. 31-26.*

(Continued)

*Primary Examiner* — Jennifer H Gay
(74) *Attorney, Agent, or Firm* — Chadwick A. Sullivan; Wesley Noah

(57) ABSTRACT

A collision avoidance system including a plurality of inclinometers in offset wellbores and a processing unit for receiving a vibration signal from the inclinometers and determining a distance between the offset wellbore and a central wellbore based on the vibration signal. Also, a method of avoiding wellbore collisions by determining relative movement of a drill bit within a central wellbore including the steps of determining an original distance between the central wellbore and an offset wellbore, drilling in the central wellbore so that the drill bit moves a known distance with respect to the offset wellbore, capturing vibration readings during the drilling step, characterizing movement of the drill bit based on the drilling step, and calculating drill bit movement during drilling with respect to the offset wellbore based upon the characterizing step.

20 Claims, 2 Drawing Sheets

(56) References Cited

U.S. PATENT DOCUMENTS

| | | | | |
|---|---|---|---|---|
| 7,003,439 | B2 * | 2/2006 | Aldred et al. | 703/10 |
| 7,114,578 | B2 * | 10/2006 | Hutchinson | 175/40 |
| 7,191,850 | B2 * | 3/2007 | Williams | 175/45 |
| 8,095,317 | B2 * | 1/2012 | Ekseth et al. | 702/7 |
| 8,393,412 | B2 * | 3/2013 | Camwell et al. | 175/45 |
| 2002/0103630 | A1 * | 8/2002 | Aldred et al. | 703/10 |
| 2003/0156494 | A1 * | 8/2003 | McDaniel et al. | 367/35 |
| 2004/0104797 | A1 * | 6/2004 | Hall et al. | 336/132 |
| 2005/0052949 | A1 * | 3/2005 | Gaston et al. | 367/57 |
| 2005/0183887 | A1 * | 8/2005 | Rodney | 175/26 |
| 2005/0269139 | A1 * | 12/2005 | Shen et al. | 175/430 |
| 2005/0279532 | A1 * | 12/2005 | Ballantyne et al. | 175/40 |
| 2006/0081412 | A1 * | 4/2006 | Wright et al. | 181/104 |
| 2006/0133205 | A1 * | 6/2006 | Van Kuijk et al. | 367/35 |
| 2007/0061081 | A1 * | 3/2007 | Moran | 702/9 |
| 2007/0153628 | A1 * | 7/2007 | Mathiszik et al. | 367/57 |
| 2007/0168056 | A1 * | 7/2007 | Shayegi et al. | 700/48 |
| 2007/0203648 | A1 * | 8/2007 | Poedjono et al. | 701/301 |
| 2007/0256828 | A1 * | 11/2007 | Birchak et al. | 166/249 |
| 2007/0278009 | A1 * | 12/2007 | Hernandez | 175/40 |
| 2009/0283355 | A1 * | 11/2009 | Minto et al. | 181/106 |
| 2010/0096186 | A1 * | 4/2010 | Ekseth et al. | 175/45 |
| 2010/0126718 | A1 * | 5/2010 | Lilley | 166/253.1 |
| 2010/0200296 | A1 * | 8/2010 | Camwell et al. | 175/50 |
| 2010/0200743 | A1 * | 8/2010 | Forster et al. | 250/254 |
| 2010/0212962 | A1 * | 8/2010 | Rosten et al. | 175/40 |
| 2010/0284250 | A1 * | 11/2010 | Cornish et al. | 367/124 |
| 2010/0300756 | A1 * | 12/2010 | Bergstrom et al. | 175/45 |
| 2011/0024189 | A1 * | 2/2011 | Saeed et al. | 175/40 |
| 2011/0031016 | A1 * | 2/2011 | Lowdon et al. | 175/40 |
| 2011/0100712 | A1 * | 5/2011 | Poedjono | 175/45 |
| 2012/0056751 | A1 * | 3/2012 | Field | 340/854.6 |
| 2014/0307523 | A1 * | 10/2014 | Elder et al. | 367/25 |

OTHER PUBLICATIONS

Rutledge, J.T., Nambe Geophysical, Inc., W.S. Phillips and L.S. House, Los Alamos National Laboratory, and R.J. Zinno, Union Pacific Resources Company; Expanded Abstracts "Microseismic mapping of a Cotton Valley hydraulic fracture using decimated downhole arrays", Sep. 1998, Society of Exploration Geophysics, International Exposition.*

Stagg et al., "Watchdog: An anti-collision wellhead monitoring system," SPE 22123 (1991).

International search report for the equivalent PCT patent application No. PCT/GB2010/001484 issued on Sep. 30, 2011.

* cited by examiner

COLLISION AVOIDANCE SYSTEM WITH OFFSET WELLBORE VIBRATION ANALYSIS

CROSS-REFERENCE TO RELATED APPLICATION

This application claims priority to U.S. Provisional Patent Application No. 61/232,105, filed Aug. 7, 2009, which is incorporated herein by reference.

BACKGROUND OF THE DISCLOSURE

1. Field of the Disclosure

The subject disclosure relates to downhole drilling, and more particularly to improved systems and method for avoiding collisions in downhole drilling.

2. Background of the Related Art

Well or wellbore collisions are obvious health and safety risks as well as inefficient. Thus, well collisions should be avoided. However, in situations of very little clearance between the subject and offset wells, conventional gyro surveying only provides some margin for error. It is advantageous to know if another well has been hit. It is also desirable to be able to position the subject well a certain distance from the offset wells to avoid collision. Conventional gyro while drilling or wireline gyro systems cannot provide the necessary level of accuracy unless considerable time is taken to conduct surveys, which use up valuable rig time.

SUMMARY OF THE INVENTION

In view of the above, the subject technology provides a system that can detect close proximity to a well and a well collision. The subject technology uses multiple responses from offset wells to steer the subject well.

In one embodiment, the subject disclosure is directed to using unidirectional inclinometers placed in offset wellbores. These inclinometers are wireless, and the respective signal outputs can be received and plotted. As you start to drill, vibrations from the nearby offset wellbores are acquired. Each response will be slightly different. As the original position is known (from a good quality gyro survey for instance), a picture is built of the relative inclinometer responses to that position. As drilling continues on, these responses are monitored and a relative well path is built from this information. Software running on a computer is used to process the inclinometer responses and process the changes in inclinometer response that correspond to the relative movement of the drill bit with respect to the offset wellbore. The individual inclinometers produce a response showing whether the bit is getting closer or further away. By triangulation, a relative position between the subject wellbore and offset wellbores can be determined.

The subject technology is also directed to a method of using inclinometers to "listen" to the vibrations caused by the bit in offset wellbores. If you have three or more offset wells in close proximity, one can assimilate all the inclinometer data to provide a relative position and "steer" the subject wells to avoid a collision. This technique would be of particular use when drilling in an existing field with poor offset well survey data. In one embodiment, geophones are used in offset wells to measure the drill bit position by access to the offset wellbores, which may include shutting in wells.

In one embodiment, the subject technology is directed to a collision avoidance system including a plurality of inclinometers in offset wellbores and a processing unit for receiving a vibration signal from the inclinometers and determining a distance between the offset wellbore and a central wellbore based on the vibration signal. The system may be configured such that the inclinometers are unidirectional and attached directly to a conductor above a cellardeck of the offset wellbore. The processing unit may include a data processing surface system for logging the vibration signal and a personal computer for determining the distance based on the logged vibration signal and initialization data. The initialization data may include vibration data with a drill bit in the central wellbore with a respective mud pump on and off, vibration data with the drill bit at a bottom of the central wellbore with 50% of normal rotation of the drill bit, and vibration data with the drill bit at the bottom with 100% of normal rotation.

The subject technology is also directed to a method for collision avoidance in a wellbore including the steps of capturing vibration signals in at least one offset wellbore using an inclinometer, receiving the vibration signals at a data processing system, comparing the vibration signals to baseline vibration signals to determine changes in a vibration response, calculating a distance change between a central wellbore and the at least one offset wellbore based on the comparison of the vibration signals and the baseline vibration signals, and utilizing the distance change to avoid a collision.

The method may further include the step of calculating an initial distance between the central wellbore and the at least one offset wellbore based on initialization vibrations signals selected from the group consisting of: vibration data with a drill bit in the central wellbore with a respective mud pump on; vibration data with a drill bit in the central wellbore with a respective mud pump off; vibration data with the drill bit at a bottom of the central wellbore with 50% of normal rotation of the drill bit; vibration data with the drill bit at the bottom with 100% of normal rotation; and combinations thereof.

The method may still further include the steps of logging the vibration signals when drilling ahead, discarding logged vibration signals when a drilling formation change occurs, resetting the baseline vibration signals such that distance change is subsequently assessed from the drilling formation change, and steering a drill bit in the central wellbore based on the distance change. The steering may be based on a triangulation calculation.

The method may also include the steps of assessing a quality of offset conductor cement based on analysis of the vibration signals from a plurality of offset wellbores and transmitting the vibration signals to the data processing system using a wireless transmitter.

Also, the subject disclosure is also directed to a method of avoiding wellbore collisions by determining relative movement of a drill bit within a central wellbore including the steps of determining an original distance between the central wellbore and an offset wellbore, drilling in the central wellbore so that the drill bit moves a known distance with respect to the offset wellbore, capturing vibration readings during the drilling step, characterizing movement of the drill bit based on the drilling step, and calculating drill bit movement during drilling with respect to the offset wellbore based upon the characterizing step. The drill bit movement is typically in an approximately linear relationship with respect to the vibration readings. The method may also include steering the drill bit within the central wellbore to avoid a well collision with the offset wellbore, logging the vibration readings in a data processing system, using previous drilling data in the central wellbore as characterization data for a subsequent central wellbore with the central wellbore being an offset wellbore thereto, creating and displaying a travelling cylinder plot based on the drill bit movement, or calculating the original distance between the central wellbore and the at least one offset wellbore based on initialization vibrations signals selected from the group consisting of: vibration data with a drill bit in the central wellbore with a respective mud pump on; vibration data with a drill bit in the central wellbore with a respective mud pump off; vibration data with the drill bit at a bottom of the central wellbore with 50% of normal rotation of the drill bit; vibration data with the drill bit at the bottom with 100% of normal rotation; and combinations thereof. The original distance may be determined by a survey and the capturing step includes providing an inclinometer in the offset wellbore.

It should be appreciated that the present technology can be implemented and utilized in numerous ways, including without limitation as a process, an apparatus, a system, a device, a method for applications now known and later developed or a computer readable medium. Additional, the subject technology may be rearranged and combined in any order or combination, such as by reordering and/or combining the recited claims. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings.

DETAILED DESCRIPTION OF PREFERRED EMBODIMENTS

The present disclosure overcomes many of the prior art problems with respect to avoiding wellbore collisions. The advantages, and other features of the system disclosed herein, will become more readily apparent to those having ordinary skill in the art from the following detailed description of certain preferred embodiments taken in conjunction with the drawings which set forth representative embodiments of the present invention.

Figure 1:
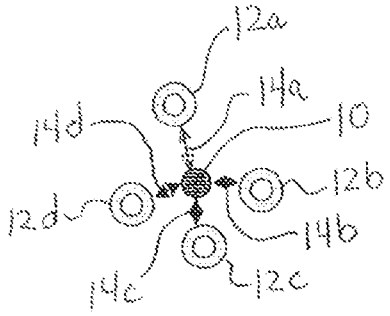
FIG. 1 is an overhead schematic view of several wellbores.

Referring now to FIG. 1, an overhead schematic view of several wellbores is shown. For purposes of description, a central wellbore 10 is shown surrounded by four offset wellbores 12*a-d*. The arrangement and number of offset wellbores 12 around the central wellbore 10 can be any number and/or configuration. Exemplary center to center (Ct-Ct) distances 14*a-d* are shown between the central wellbore 10 and offset wellbores 12*a-d*.

Figure 2:
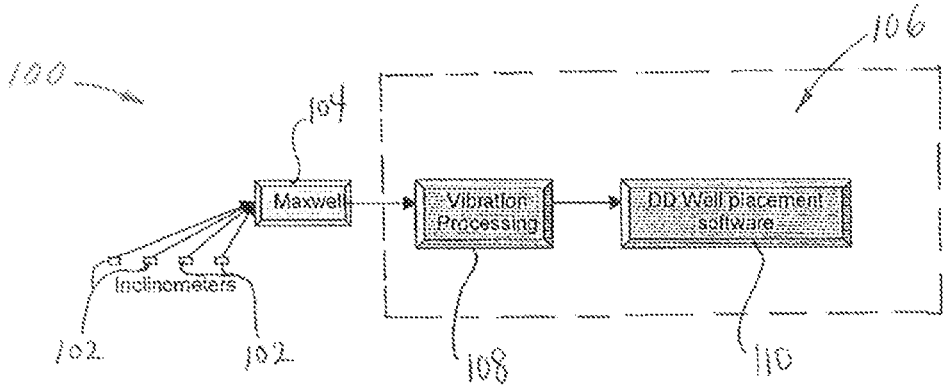
FIG. 2 is a schematic representation of a collision avoidance system in accordance with the subject disclosure.

Referring to FIG. 2, a schematic representation of a collision avoidance system 100 in accordance with the subject technology is shown. In brief overview, the system 100 prevents intersection between the central wellbore 10 and any of the offset wellbores 12 by monitoring the respective Ct-Ct distances 14. By monitoring the Ct-Ct distances 14, the drill bit (not shown) in the central wellbore 10 can be steered to avoid collision.

The system 100 uses a plurality of inclinometers 102, one for each offset wellbore 12. In one embodiment, the hardware includes unidirectional inclinometers 102 with wireless transmitters and a receiving unit (not shown schematically). Preferably, there is no requirement for borehole access. The inclinometers 102 are attached directly to the conductors anywhere above the cellardeck.

The inclinometers 102 output data wireles sly to the receiving unit, which is attached to a surface system 104. In one embodiment, the surface system 104 is a Maxwell surface system, available from Schlumberger Ltd. of Houston, Tex., for logging the inclinometer data. The Maxwell surface system 104 is particularly well suited because it is a logging system for measurement while drilling and logging while drilling tools.

Still referring to FIG. 2, the logged inclinometer data from the surface system 104 is transferred to a personal computer (PC) 106 for further analysis. The PC 106 analyzes the relative vibration measurements in a vibration processing module 108. A well placement software module 110 of the PC 106 calculates changes in the vibration response as well as the Ct-Ct distances 14. Once the Ct-Ct distances 14 are known, appropriate adjustments may be made to avoid collision. Preferably, the well placement software module 110 finds trends and more importantly changes in vibration data to determine and display the changes and updated Ct-Ct distances 14. In one embodiment, the well placement software module 110 is Change point, available from Schlumberger Ltd. of Houston, Tex.

Figure 3:
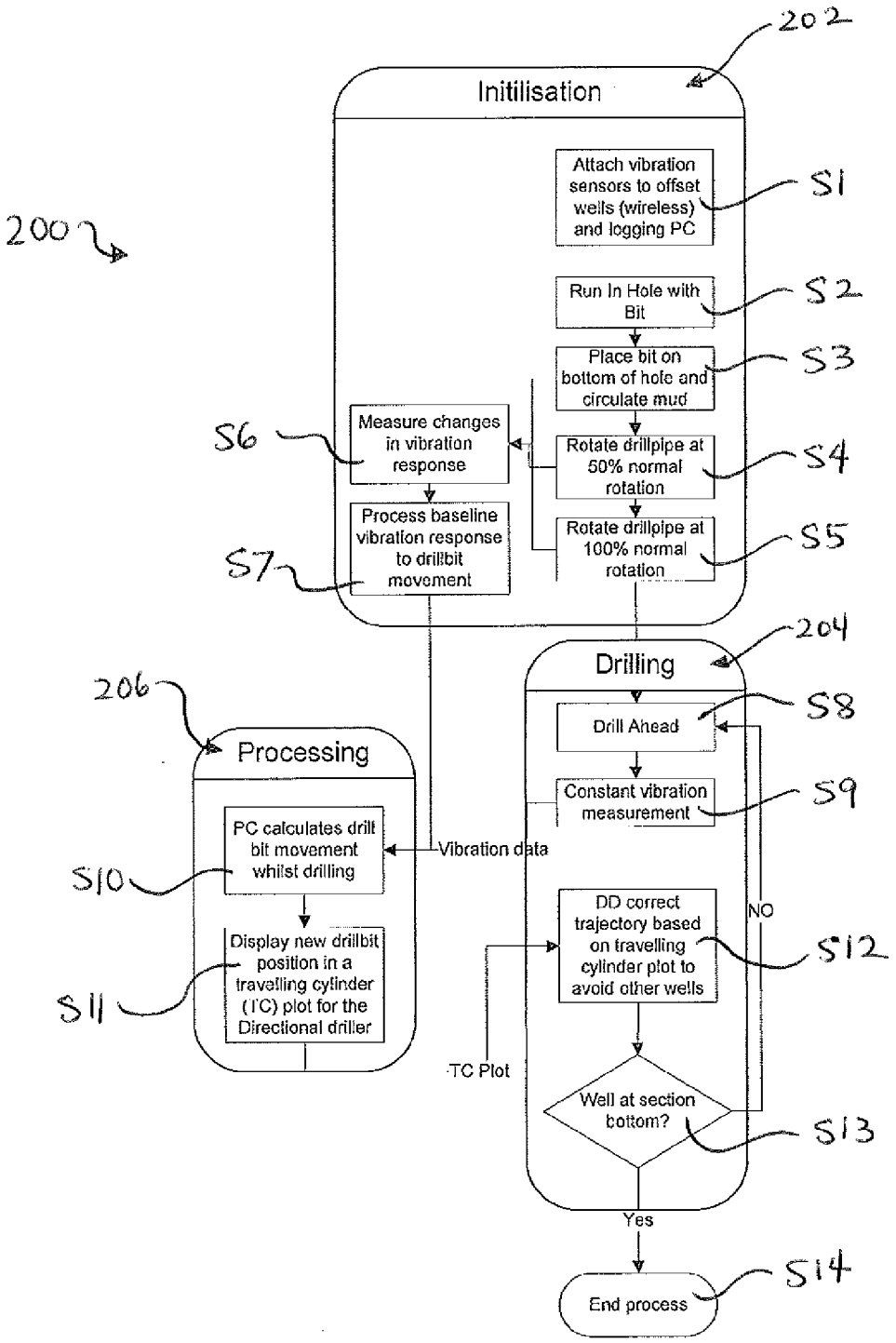
FIG. 3 is a flowchart illustrating the steps for a method for avoiding wellbore collisions in accordance with the subject disclosure.

Referring now to FIG. 3, a flowchart or method 200 illustrating the steps of avoiding wellbore collisions in more detail is shown. The flowchart 200 is grouped into three interrelated parts of an initialization section 202, a drilling section 204, and a processing section 206.

Initialization

The method 200 utilizes initial measurements as a baseline to determine subsequent relative movement of the drill bit. By determining relative movement of the drill bit, the directional driller can the steer the drill bit within the central wellbore 10 to avoid a well collision. At step S1, the system 100 is installed in the wellbores 10, 12. The surface system 104 and PC 106 are connected and readied for initialization.

At step S2, the drill bit is lowered into the central wellbore 10 and drilling commences with the drill bit above the bottom of the central wellbore 10. During this drilling, vibration data is collected from which an origin or initial Ct-Ct distances 14 are determined and set. Subsequently, any deviation seen by the inclinometers in the offset wellbores 12 from this response or origin will indicate a movement in one direction of the drill bit in the central wellbore 10. Such well placement calculations are also performed for each offset wellbore 12. Thus, a Travelling cylinder plot can be generated to allow the directional driller to decide on how to steer the drill bit to avoid a well collision.

Several additional baseline vibration measurements are also taken at different stages in the drilling process in steps S3-S5. At step S3, the drill bit is lowered to the bottom of the central wellbore 10 with the drilling mud circulated (drill bit on bottom, pumps on). With the drill bit on the bottom, another reading is taken without the drilling mud being circulated (drill bit on bottom, pumps off). The readings from the inclinometers 102 are logged by the surface system 104 and processed in the PC 106.

At step S4, more vibration readings are taken with the drill bit on the bottom of the central wellbore 10 and rotating at 50% of normal drilling rotation. Similarly, at step S5, a last initialization vibration reading is taken with the drill bit on the bottom and rotating at 100% normal drilling rotation or normal speed. The initialization vibration readings allow establishing a baseline vibration reading for each of the offset wellbores 12 with varying drill string RPM as well as the effects of the mud pumps being included. Thus, the PC 106 establishes a baseline to be used to determine the relative change in position of the drill bit as drilling occurs down along the planned wellbore trajectory.

Table 1 below shows some exemplary data related to a starting position. For example, offset wellbore 12*a* has a Ct-Ct distance 14*a* of 5 m with a corresponding vibration reading of 100 dB.

TABLE 1

| | Ct-Ct (m) | Vibration |
|---|---|---|
| Offset well 12a | 5 | 100 dB |
| Offset well 12b | 3 | 150 dB |
| Offset well 12c | 4 | 125 dB |
| Offset well 12d | 3 | 150 dB |

At step S6, some drilling allows taking vibration readings and measurement of the changes corresponding to known drill bit movement. At step S7, because the drill bit movement is known, one can characterize drill bit movement in terms of vibration response and store the calibration in the PC 106. As this example continues, a relatively linear response between vibration readings and drill bit movement is assumed.

Drilling and Processing

At step S8, normal drilling starts. During step S9, the inclinometers 102 constantly take vibration readings and pass data along to the surface system 104. At step S10, the surface system 104 logs the vibration data while the PC 106 processes the vibration data to determine drill bit movement. If the vibration measurements are constant, then it is assumed that the relative positions (i.e., the Ct-Ct distances 14) of the wellbores 10, 12 are correspondingly constant.

At step S11, the PC 106 displays the new drill bit position in a traveling cylinder (CT) plot for the directional driller. One method for calculating the relative position changes is triangulation. Once a relative distance between the wellbores 10, 12 is determined from the changes in vibration response, a relative change in distance between the drill bit and the offset wells can be determined. Based on the distance, the PC 106 can triangulate a new position for the drill bit and the directional driller can steer accordingly as shown at step S12.

Table 2 below is a second set of Ct-Ct distances 14 and corresponding vibration readings after 10 feet of drilling past the point of Table 1. As can be seen, when offset wellbore 12*a* is computed to have moved 2 m closer to the central wellbore 10 (e.g., 5-3 m), the roughly opposing wellbore 12*c* has had a approximately opposite increase in the Ct-Ct distance 14*c* to 4 m with the corresponding vibration reading changing approximately a proportional amount. Thus, the relationship between Ct-Ct distance 14 and vibration reading level in dB is substantially linear or proportional.

TABLE 2

| | Ct-Ct (m) | Vibration |
|---|---|---|
| Offset well 12a | 3 | 150 dB |
| Offset well 12b | 4 | 125 dB |
| Offset well 12c | 6 | 75 dB |
| Offset well 12d | 2 | 200 dB |

There are a number of assumptions here, the formation is homogeneous, the surface positions are known, and that there has been field test done to establish exactly the bandwidth of the frequency to be measured. When drilling ahead, changes in drilling formation, such as a change from concrete to seabed, will have to be noted so that the vibration processing module 108 can discard the change in vibration response and create a new baseline using the new vibration reading. From that point forward, relative movement is assessed from the point of formation change.

Still referring to FIG. 3, at step S13, the method 200 determines if the central wellbore 10 is at a section bottom. If not, the method 200 returns to step S8 to continue drilling and correcting position to avoid collision. If the section bottom has been reached, the method 200 proceeds to step S14, where the method 200 stops.

The method of the subject disclosure could also be used further down the central wellbore 10 with the inclinometers 102 attached to wireline and run in the offset wellbores 12 or built into the production liners for a more permanent solution. Vibration data could then be stored as other wells are drilled in order to provide a high quality description of the vibration propagation through the appropriate drilling formation. In effect, an area can be thoroughly and deeply characterized.

The subject technology allows the relative position of a drill bit to be assessed without the need for gyros or measuring while drilling data. It will allow the user to avoid well collisions even if the offset wellbore positions are not well known. In the case of very close proximity, the subject technology will allow wellbore placement where no other technology can be reliably used because the accuracy of top hole gyros are not good enough to provide a solution without considerable rig time and the possibility of washouts. Additionally, it is possible to assess the quality of the offset conductor cement with experience of vibration analysis from a number of jobs. An additional advantage of these techniques is in not having to shut in production on offset wellbores.

While the invention has been described with respect to preferred embodiments, those skilled in the art will readily appreciate that various changes and/or modifications can be made to the invention without departing from the spirit or scope of the invention. For example, each claim may depend from any or all claims in a multiple dependent manner even though such has not been originally claimed.

What is claimed is:

1. A collision avoidance system comprising:

at least one inclinometer in an offset wellbore; and a processing unit for receiving a vibration signal from the at least one inclinometer, the processing unit comprising a vibration processing module to analyze the vibration signal and a well placement module to determine and monitor distance between the offset wellbore and a central wellbore based on the vibration signal; and a comparison of the vibration signal to a baseline vibration signal to determine changes in a vibration response.

2. A collision avoidance system as recited in claim 1, wherein the at least one inclinometer is selected from the group consisting of: a unidirectional inclinometer; an inclinometer attached directly to a conductor above a cellardeck of the offset wellbore; an inclinometer built into a production liner; and combinations thereof.

3. A collision avoidance system as recited in claim 1, wherein the processing unit includes a data processing surface system for logging the vibration signal and a personal computer for determining the distance based on the logged vibration signal and initialization data.

4. A collision avoidance system as recited in claim 3, wherein the initialization data includes vibration data with a drill bit in the central wellbore with a respective mud pump on and off, vibration data with the drill bit at a bottom of the central wellbore with 50% of normal rotation of the drill bit, and vibration data with the drill bit at the bottom with 100% of normal rotation.

5. A method for collision avoidance in a wellbore comprising the steps of:

obtaining baseline vibration signals by operating a drill bit in different operational configurations at a plurality of points in a central wellbore;

capturing vibration signals in at least one offset wellbore using an inclinometer;

receiving the vibration signals at a data processing system;

comparing the vibration signals to the baseline vibration signals to determine changes in a vibration response;

calculating a distance change between a central wellbore and the at least one offset wellbore based on the comparison of the vibration signals and the baseline vibration signals; and utilizing the distance change to avoid a collision.

6. The method as recited in claim 5, further comprising calculating an initial distance between the central wellbore and the at least one offset wellbore based on initialization vibrations signals selected from the group consisting of: vibration data with a drill bit in the central wellbore with a respective mud pump on; vibration data with a drill bit in the central wellbore with a respective mud pump off; vibration data with the drill bit at a bottom of the central wellbore with 50% of normal rotation of the drill bit; vibration data with the drill bit at the bottom with 100% of normal rotation; and combinations thereof.

7. The method as recited in claim 5, further comprising logging the vibration signals when drilling ahead, discarding logged vibration signals when a drilling formation change occurs, and resetting the baseline vibration signals such that distance change is subsequently assessed from the drilling formation change.

8. The method as recited in claim 5, further comprising steering a drill bit in the central wellbore based on the distance change.

9. The method as recited in claim 8, wherein the steering is based on a triangulation calculation.

10. The method as recited in claim 5, further comprising assessing a quality of offset conductor cement based on analysis of the vibration signals from a plurality of offset wellbores.

11. The method as recited in claim 5, further comprising transmitting the vibration signals to the data processing system using a wireless transmitter.

12. A method of avoiding wellbore collisions by determining relative movement of a drill bit within a central wellbore comprising:

obtaining baseline vibration readings by operating a drill bit in different operational configurations at a plurality of points in a central wellbore;

determining an original distance between the central wellbore and an offset wellbore;

drilling in the central wellbore so that the drill bit moves a known distance with respect to the offset wellbore;

capturing vibration readings during drilling;

comparing the vibration readings to the baseline vibration readings to determine changes in a vibration response;

characterizing movement of the drill bit based on the drilling step;

calculating drill bit movement during drilling with respect to the offset wellbore based upon the comparison of the vibration signals and the baseline signals; and monitoring distance between the drill bit and the offset wellbore during drilling.

13. The method as recited in claim 12, wherein the drill bit movement is in an approximately linear relationship with respect to the vibration readings.

14. The method as recited in claim 12, further comprising steering the drill bit within the central wellbore to avoid a well collision with the offset wellbore.

15. The method as recited in claim 12, wherein an inclinometer in the offset wellbore constantly takes the vibration readings.

16. The method as recited in claim 12, further comprising logging the vibration readings in a data processing system.

17. The method as recited in claim 12, further comprising using previous drilling data in the central wellbore as characterization data for a subsequent central wellbore with the central wellbore being an offset wellbore thereto.

18. The method as recited in claim 12, further comprising creating and displaying a travelling cylinder plot based on the drill bit movement.

19. The method as recited in claim 12, further comprising calculating the original distance between the central wellbore and the at least one offset wellbore based on initialization vibrations signals selected from the group consisting of: vibration data with a drill bit in the central wellbore with a respective mud pump on; vibration data with a drill bit in the central wellbore with a respective mud pump off; vibration data with the drill bit at a bottom of the central wellbore with 50% of normal rotation of the drill bit; vibration data with the drill bit at the bottom with 100% of normal rotation; and combinations thereof.

20. The method as recited in claim 12, wherein the original distance is determined by a survey and the capturing step includes providing an inclinometer in the offset wellbore.

* * * * *